United States Patent [19]

Horvath et al.

[11] Patent Number: 4,940,228

[45] Date of Patent: Jul. 10, 1990

[54] BOXING TRAINING DEVICE

[76] Inventors: Kordelia Horvath, Hallerstrass 5b, D-2000 Hamburg 13; Victor Horvath, Hallerstrass 5b, 200 Hamburg 13, both of Fed. Rep. of Germany

[21] Appl. No.: 148,217

[22] PCT Filed: Apr. 16, 1987

[86] PCT No.: PCT/EP87/00205

§ 371 Date: Feb. 12, 1988

§ 102(e) Date: Feb. 12, 1988

[87] PCT Pub. No.: WO87/06149

PCT Pub. Date: Oct. 22, 1987

[30] Foreign Application Priority Data

Apr. 16, 1986 [DE] Fed. Rep. of Germany ..... 3612774

[51] Int. Cl.[5] ..... A63B 69/00

[52] U.S. Cl. ..... 272/76; 273/386

[58] Field of Search ..... 272/76, 77, 78, 93; 73/379, 380, 381; 273/55 R, 55 A, 348, 374, 378, 386, 387, 391, 396, 397, 127 R; 222/DIG. 5

[56] References Cited

U.S. PATENT DOCUMENTS

| | | | |
|---|---|---|---|
| D. 169,243 | 4/1953 | Doherty | 272/76 |
| 734,911 | 7/1903 | Mangels | 273/374 |
| 2,092,905 | 9/1937 | Brumbelow | 273/386 |
| 4,147,344 | 4/1979 | Lee | 73/379 |
| 4,330,119 | 5/1982 | Marshall | 272/76 |
| 4,345,755 | 8/1982 | Eidson | 272/78 |
| 4,434,980 | 3/1984 | Babineaux | 272/78 |
| 4,635,929 | 1/1987 | Shustack | 272/76 |
| 4,721,302 | 1/1988 | Murphy | 272/76 |

FOREIGN PATENT DOCUMENTS

| | | |
|---|---|---|
| 361031 | 6/1929 | Belgium . |
| 2822205 | 11/1979 | Fed. Rep. of Germany . |
| 2107202 | 4/1983 | United Kingdom . |

*Primary Examiner*—Stephen R. Crow

*Attorney, Agent, or Firm*—Sixbey, Friedman, Leedom & Ferguson

[57] ABSTRACT

A boxing training device involving the action of at least two reaction bodies that move in response to kinetic energy imposed by the glove of a boxer either directly upon a reaction body or indirectly via an elastic body. The result of the boxing impact imposed is displayed via a measuring device. Embodiments for training of one boxer or competitive training of two boxers are achieved, as are embodiments involving freely movable and tethered elastic bodies used in conjunction with freely movable reaction bodies.

10 Claims, 5 Drawing Sheets

BOXING TRAINING DEVICE

BACKGROUND OF THE INVENTION

The invention relates to a boxing training device involving the action of at least one reaction body on a mobile reaction area.

Various arrangements are known for training boxers. The most common training devices are a punching ball fixed on an elastic bar, a boxing ball fixed between ropes, and a sandbag. These devices are more or less suited for training punches but are not suited for training spatially or temporally coordinated boxing movements.

SUMMARY OF THE INVENTION

The object of the invention is to construct a device providing training situations with spatially staggered movement planes similar to competition conditions.

According to the invention, this object is achieved by using a reaction body that takes up the kinetic energy produced during the action of at least one boxing glove, said energy being dependent on punching force and punching direction, and transmitting this energy to a measuring device.

Such a device is used for training spatially and temporarily coordinated boxing movements, including combinations of such movements, as well mechanical punching exercises. The device according to the invention can be used simultaneously by two boxers in a competition and can show the effect of actions in spatially staggered movement planes. The results obtained by registering a punch (hit), or a combination series of punches can be required from the boxer, whereby the time element is also taken into account. This device responds in direct relation to the action of the user. Measuring the result (hits) is performed by a simple method. Physical strength and persistence are trained as well as reactivity and realization, and mastering of changing situations. An individual adjustment of the degree of difficulty is achieved by changing movable parts of the device. Furthermore, the device is adapted to the user. Due to unexpected situations, the device is very amusing and can be used in sporting clubs and other institutions.

Further features of the invention are described hereinafter relative to the drawings, in which:

DETAILED DESCRIPTION OF THE PREFERRED EMBODIMENTS

Figure 1:
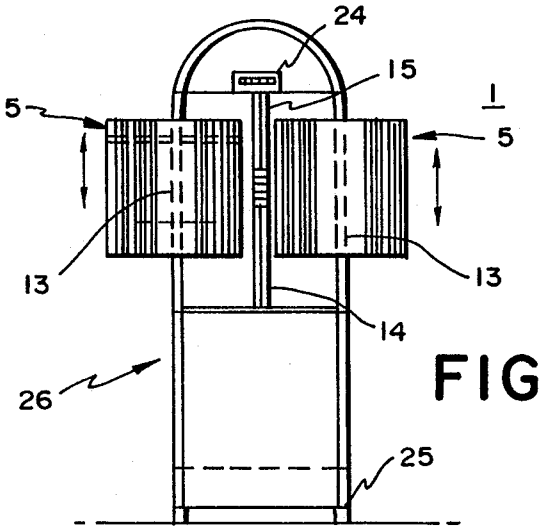
FIG. 1 shows a device with reaction bodies that rotate around a vertical axis, in a front view.
Figure 2:
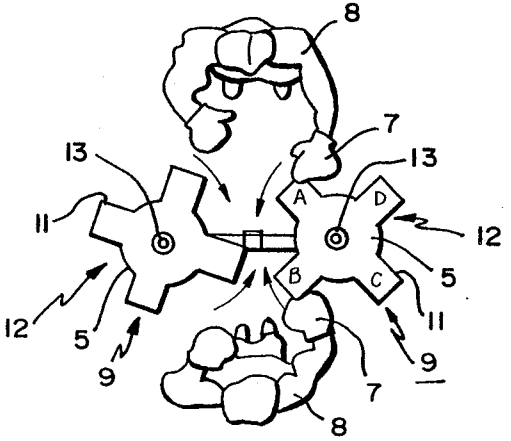
FIG. 2 is a top view of the device according to FIG. 1.

FIGS. 1 and 2 show a device 1 with two reaction bodies 5 that are arranged on a pedestal 25. The reaction bodies are in the form of vertically shiftable revolution bodies 9 that rotate around a respective vertical axis of rotation 13. Each rotational axis 13 is, therefore, provided as a threaded spindle on which the revolution body 9 slides by being provided with one or more nuts that have a thread pitch matched to the spindle thread and are separately and movably arranged on the spindle thread for enabling rotation of revolution body 9 with low friction force.

This device 1 is suitable for enabling two boxers 8 to spar without body contact while still providing the character of full competition. Depending on the punching force and punching frequency of each boxer 8 as well as the punching direction, the revolution bodies 9 will either move up or down from the central position due to their opposite rotations, represented by arrows in FIG. 2. A draw game is also possible, if each of the boxers 8 move one revolution body to their advantage.

A measuring scale 14 is provided in proximity to the revolution bodies 9, extending axially relative to the rotational axes 13, for showing the exact height of the revolution body 9 and the training result. It is also possible to provide a vertical console 15 on the frame 26 of device 1 with another measuring scale. Special electronic measuring devices are not necessary to show the training results, because the height displacement of the revolution body 9 from the central position is always due to the punching force and punching frequency of the boxer 8. On the other hand, appropriate sensors can still be provided which are connected, for example, to an optical or acoustical indicating instrument 24. This indicating instrument 24 can be mounted to the console 15.

The reaction areas of revolution bodies 9 can be provided e.g. with padded bars (A, B, C, and D in FIG. 2). The pedestal 25 and frame 26 prevent the boxers 8 from getting near each other. But it is also possible to provide a net between the revolution bodies so that direct body contact between boxers 8 is absolutely prevented.

Figure 3:
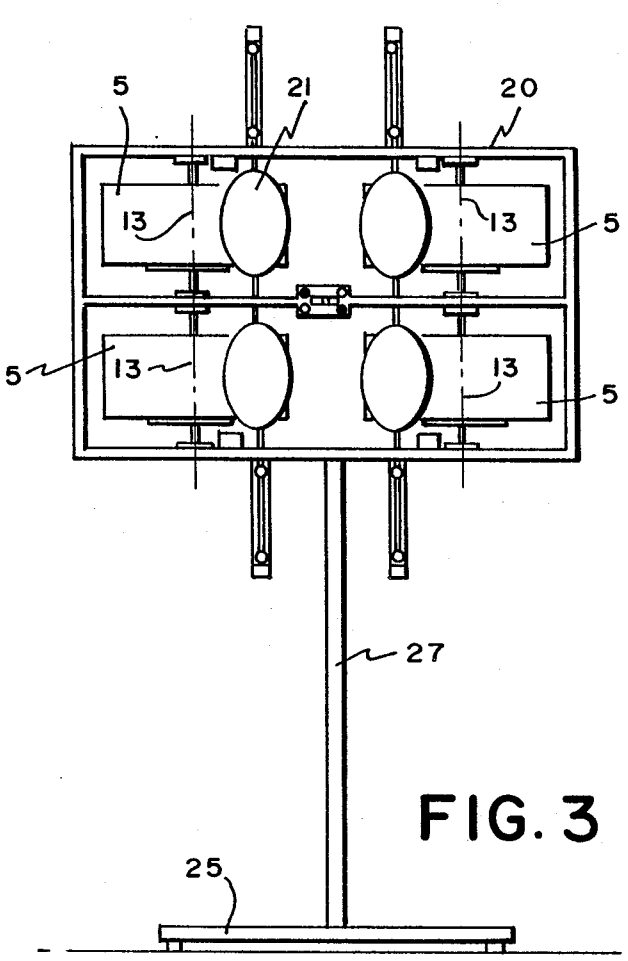
FIGS. 3–5 illustrate a further embodiment of the invention having reaction bodies rotating around a vertical axis in a front view, in a sectional side view and in a top view, respectively.
Figure 5:
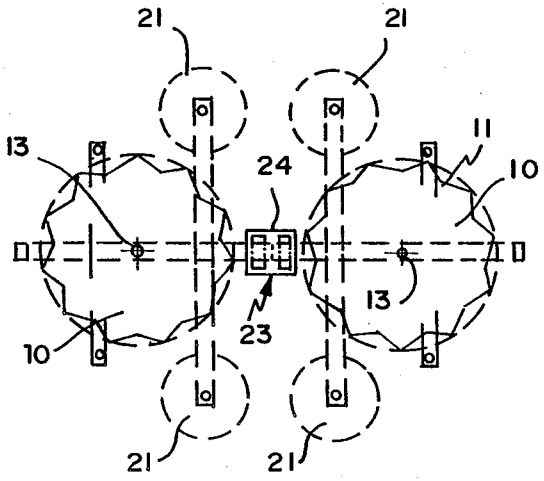
Figure 4:
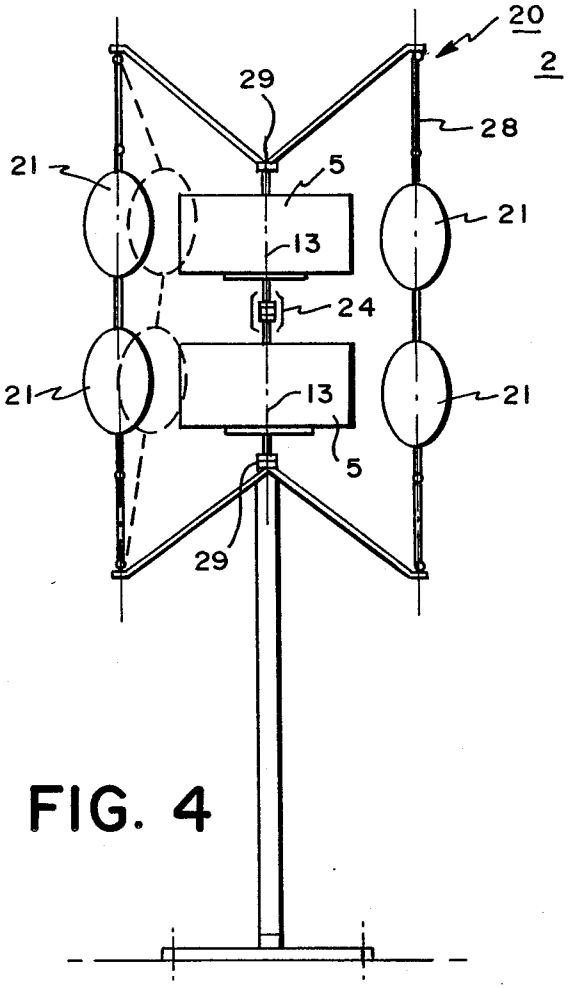

A further device 2 is shown in FIGS. 3 to 5, comprising four revolution bodies 10 which constitute the reaction bodies 5. Two revolution bodies 10 are always arranged one above the other. The rotational axes 13 of revolution bodies 10 are arranged in a box type frame 20. The box type frame 20 is supported upon a pedestal 25 by means of a support 27. The revolution bodies 10 are peripherally profiled with a number of reaction areas 11 (FIG. 5).

An elastic body 21 is provided in front of each revolution body 10 at both sides of box type frame 20 with each pair of elastic bodies 21 being connected to the box type frame 20 by means of a rope 28. Bodies 21 can be in the form of, e.g., boxing balls. Device 2 can be used by one or two boxers 8 without body contact but with full competition character. Special rotations of revolution bodies 10 are caused by punches of boxers 8 on the elastic bodies 21, if the elastic bodies 21 reach the reaction areas 11 of revolution bodies 10. Since punches on the elastic bodies 21 on one side of the device will produce an opposite rotation of the revolution bodies 5 from punches directed from the opposite side of the device, the number of revolutions detected as left- or right-hand rotations can be attributed to a particular one of the boxers 8. For this, two commutating switches 29 are provided as sensors of the measuring device for transmitting a signal to an indicating instrument 24, which may be an optical or acoustical indicating instrument, for example, a LED-display corresponding to a boxer 8. Revolution bodies 10 can be provided with a foam core covered with leather.

Figure 6:
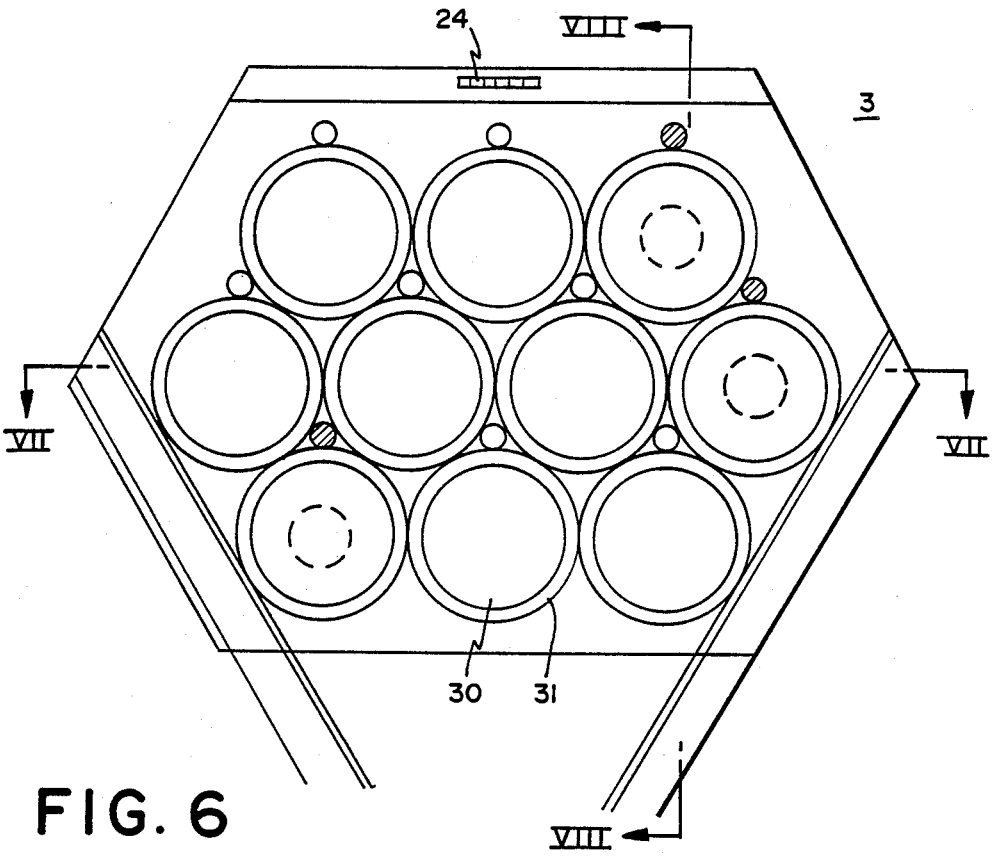
FIGS. 6–8 show an embodiment of a device with horizontal shifting reaction bodies in a front elevational view, a sectional plan view taken along line VII—VII in FIG. 6, and a sectional side view taken along line VIII—VIII in FIG. 8. respectively.
Figure 7:
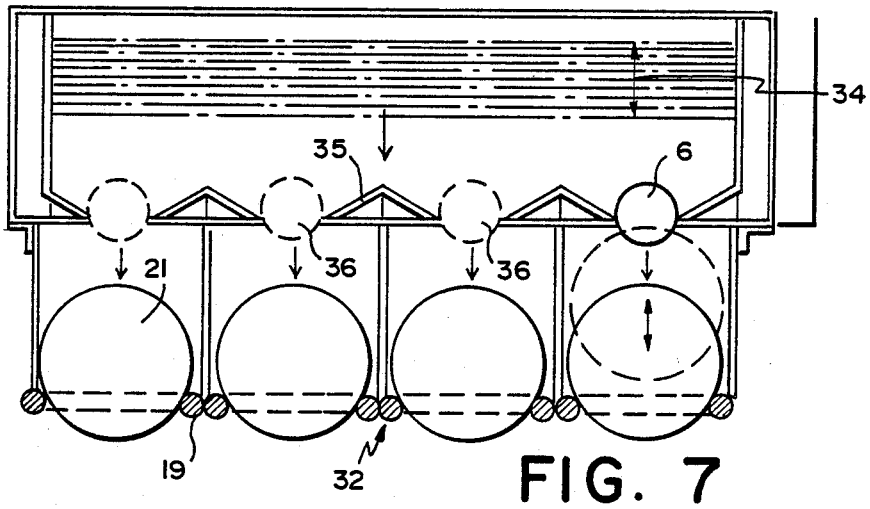
Figure 8:
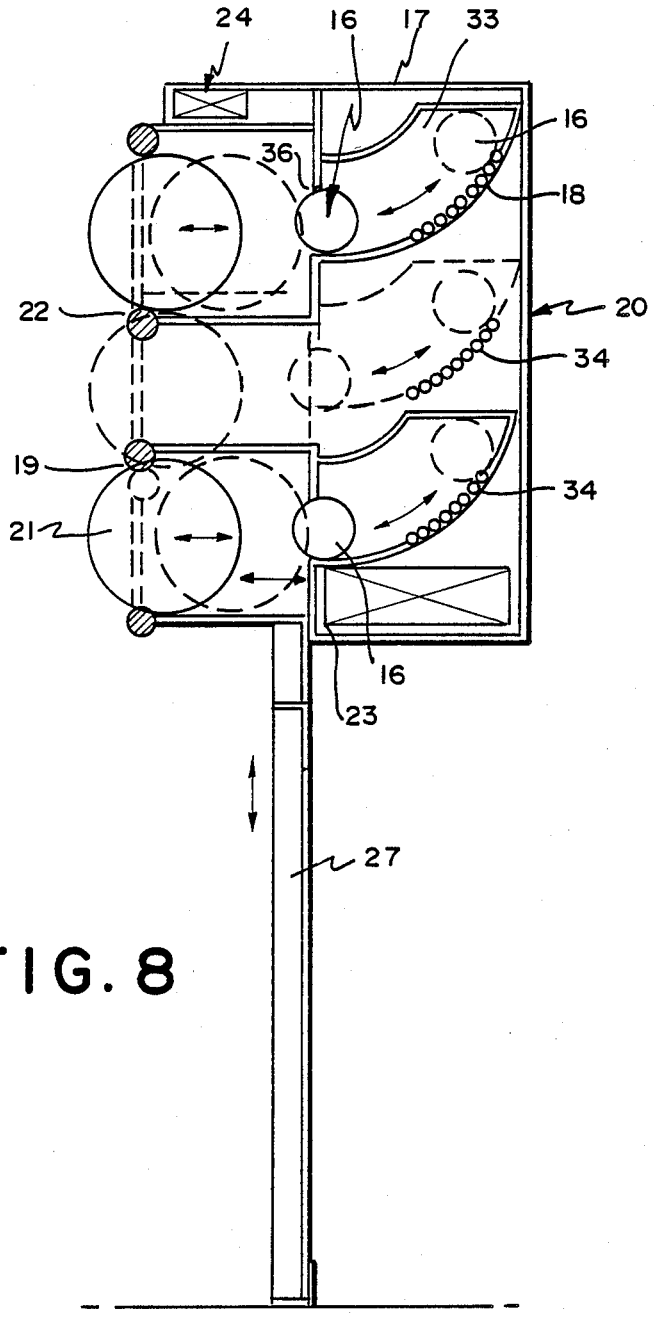

A device 3 is shown in FIGS. 6 to 8 which may be used for individual training. If such devices are used, for motivation, the practical replacement of the competitor is very important. The device 3 is also provided with a box type frame 20 that is supported on a pedestal by means of supports 27. Circular recesses 30 with padded edges 31 are arranged at the front side 32 of the device, and have a smaller diameter than that of the ball type reaction bodies 21 used in device 3. Upwardly curved channel-like pathways 33 are arranged in the rear of box type frame 20, and are provided with parallel metal bars 34 through which a weak current is passed. A globule 16 is arranged on each curved pathway 33 as a reaction body. The curved pathways 33 and the ball type elastic bodies 21 are so arranged that balls and globules meet at the center plane of the frame 20 at which a dividing wall is provided between the section with ball type bodies 21 and the sections carrying the globules 16. The sloping guide surfaces of pathways 33 and circular openings 36 are constructed to make sure that each globule 16 can reach a position where it will be pushed by a ball type body 21 without passing the dividing wall. Openings 36 are therefore smaller than the diameter of globules 16. Attitude sensors 23 are provided at pathways 33 near openings 36. Metal bars 34 also form an attitude sensor 23, but extend over the width of paths 33. According to the position of a globule 16, signal transmitters 22 are activated by attitude sensor 23, so as to designate, via an indicator lamp, a recess 30 at which a body 21 must be hit. If the hit is in time, body 21 pushes a globule 16, which runs up its pathway 33 and produces impulses via parallel metal bars 34. The number of hits can be recorded by means of an indicating instrument 24, e.g. a digital counter. Then the globule 16 runs back to one of the openings 36 and gives a new impulse via attitude sensor 23 to the signal transmitter 22.

Figure 10:
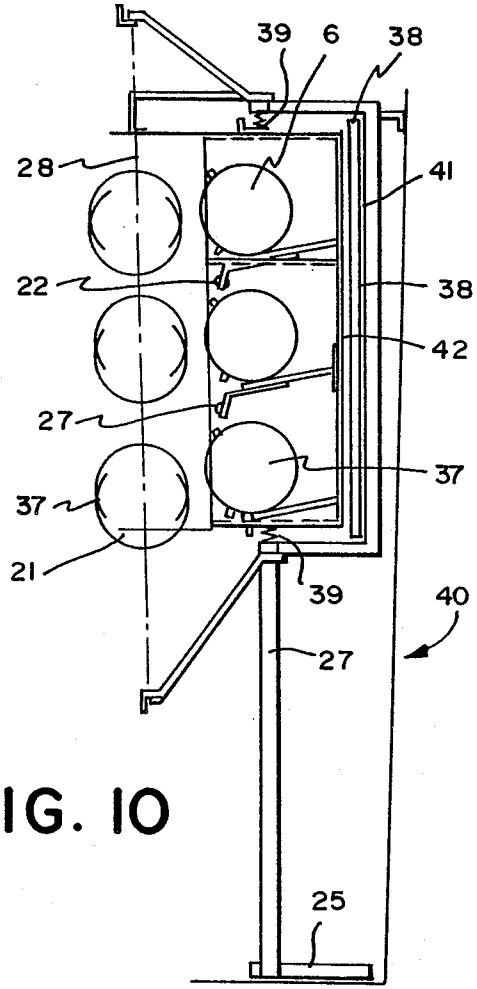
FIGS. 9 and 10 show a further embodiment of a device with horizontal shifting reaction bodies in a front view and a side view.
Figure 9:
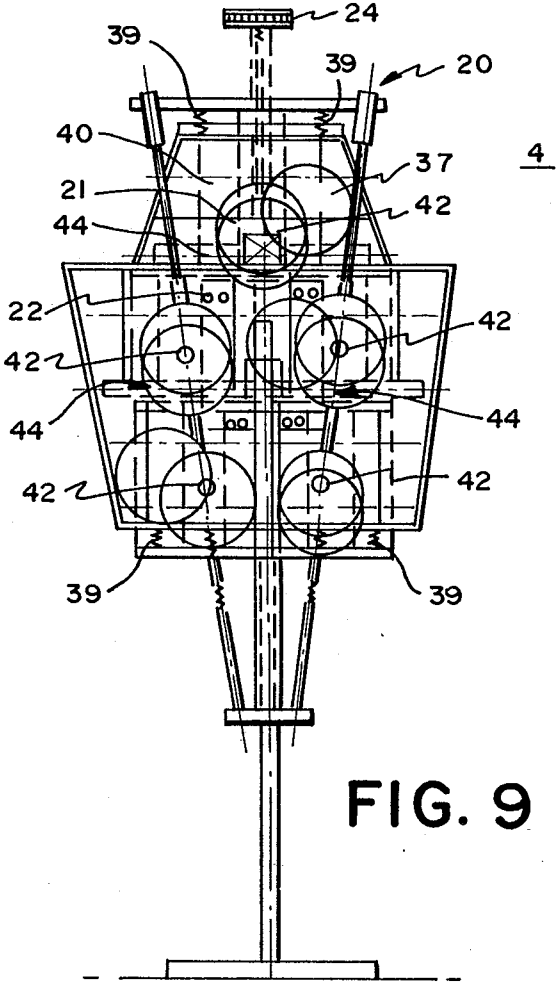

A device 4 is shown in FIGS. 9 and 10 with elastic bodies 21 that are formed by tethered boxing balls and with reaction bodies 6 that are formed by freely movable boxing balls 37. The balls 37 forming reaction bodies 6 are independently movably arranged in a multistorey frame 38 that is elastically mounted in a box type frame 20 by means of springs 39. Box type frame 20 is supported upon pedestal 25 by means of support 27. The device 4 can be used by one boxer 8, and a competitor is indicated behind the boxing balls 37 via an illuminated mirror 40.

A pressure sensor 42 is arranged at a point positioned on rear wall 41 of frame 38, and sensor 42 may be formed by a piezoelectric switch that serves as an attitude sensor 23. Pressure sensors 42 are located behind each reaction body 6 formed by a boxing ball 37. That means a punch on one of the tethered boxing balls 37 forming a body 21 is only scored if the free boxing ball 37 located just behind that body 21 is pushed back sufficiently to hit the respective sensor 42. The bottom plates 43, upon which the reaction bodies 6 roll, incline upwardly to an elevation 44 in the range of pressure sensors 42. Consequently, the reaction body 6 will not rest at that sensing position, so that the boxing ball 37 must be punched immediately. As a result, the boxer 8 is always confronted with a complex situation. He should first tip the free boxing balls 37, located in the elastically mounted frame 38, to put them in the line of fire and then punch the bodies 21, provided by the tethered boxing balls 37. The device 4, therefore, works as an accommodating sparring partner. The more intensively the device is used, the more intensive are the reactions required from the boxer 8.

The bodies 21 are tethered to the box type frame 20 by means of ropes 28. Signal transmitters 22 are provided with indicator lamps. Only one pressure sensor 42 is activated as a target position during a special period of time, and that one is designated by the respective indicator lamp. The signal transmitters 22 can be controlled by a randomizer, so that the requirements that must be met by the boxer 8 may be made even more complex. The pressure sensors 42 are connected to an indicating instrument 24 that is provided with an optical display, e.g. a LED-display. An acoustical indicating instrument can additionally be provided.

The devices 1 to 4, described hereinbefore, mediate characteristic features of boxing such as strength, staying power, agility, and reaction in a practical way. Although a direct fight with all problems of health is excluded, important advantages are still present, e.g. measuring the strength of two or more people fighting against each other, reaction training, physical training based upon age, weight, and efficiency, as well as the activation of the cardiovascular system.

We claim:

1. Boxing training device comprising a frame defining a reaction area, a measuring device for measuring punching effect, and at least two reaction bodies, the reaction bodies being freely movable within said reaction area as a means for taking up kinetic energy imposed thereon by the action of at least one boxing glove, said energy being dependent on punching force and punching direction, and for transmitting said energy to said measuring device, the measuring device being provided with sensors that are connected to indicating instruments and respectively associated with the reaction bodies, as a means for measuring and representing the punching effect from the movement of at least one of the reaction bodies, wherein each reaction body is formed of an axially symmetrical body that is carried within a frame in a manner permitting relative, free rotational, displacement between the reaction body and the frame; and wherein an axially symmetric, directly punchable, elastic body is movably arranged in front of the at least one reaction body in a manner enabling the elastic body to contact the reaction body in response to the elastic body being struck with a boxing glove.

2. Boxing training device according to claim 8, wherein said return means comprises an upwardly directed guide surface upon which a respective reaction body is displaceable.

3. Device according to claim 1, wherein said frame is a box type frame is provided, wherein a plurality of elastic bodies and said reaction bodies are movably arranged in said box type frame, and wherein an elastic mechanical device is provided for bringing said elastic bodies to a balanced position.

4. Device according to claim 1, wherein each elastic body is arranged and elastically braced in front of a respective one of the reaction bodies.

5. Device according to claim 1, wherein each said reaction body is a sphere.

6. Device according to claim 5, wherein each said elastic body is a sphere.

7. Device according to claim 1, wherein each said reaction body is a sphere.

8. Boxing training device according to claim 1, wherein the free rotational displacement of each axially symmetrical reaction body that is permitted relative to the frame is a free rolling displacement; and wherein return means is provided to bring the reaction body to a balanced position.

9. Boxing training device according to claim 1, wherein each said reaction body is formed as a body of revolution having protruding reaction areas and is mounted for producing said free rotational displacement about an axis of rotation in each of opposite, clockwise an counterclockwise, directions relative to said axis.

10. Device according to claim 9, wherein each revolution body is mounted to move coaxially with respect to said axis of rotation thereof, said revolution body moving in a respective axial direction for each of the opposite directions of rotation thereof about said axis.

* * * * *